US009478382B1

(12) United States Patent
Aromin

(10) Patent No.: US 9,478,382 B1
(45) Date of Patent: Oct. 25, 2016

(54) CIRCUIT INTERRUPTING SAFETY DEVICE

(71) Applicant: Victor V Aromin, West Warwick, RI (US)

(72) Inventor: Victor V Aromin, West Warwick, RI (US)

(73) Assignee: Tower Manufacutring Corporation, Providence, RI (US)

( * ) Notice: Subject to any disclaimer, the term of this patent is extended or adjusted under 35 U.S.C. 154(b) by 0 days.

(21) Appl. No.: 14/825,532

(22) Filed: Aug. 13, 2015

(51) Int. Cl.

| | |
|---|---|
| ***H01H 73/00*** | (2006.01) |
| ***H01H 71/58*** | (2006.01) |
| ***H01H 71/12*** | (2006.01) |
| ***H01H 71/50*** | (2006.01) |

(52) U.S. Cl.
CPC ..... *H01H 71/58* (2013.01); *H01H 71/128* (2013.01); *H01H 71/505* (2013.01); *H01H 2235/01* (2013.01)

(58) Field of Classification Search
CPC ..... H01H 83/04
USPC ..... 335/18
See application file for complete search history.

(56) References Cited

U.S. PATENT DOCUMENTS 4,001,652 A * 1/1977 Klein ..... H01H 83/04 335/18
4,630,015 A * 12/1986 Gernhardt ..... H01H 1/26 200/284
4,802,052 A * 1/1989 Brant ..... H01R 13/7135 335/18
4,939,615 A * 7/1990 Brant ..... H01R 13/7135 335/202
5,943,199 A * 8/1999 Aromin ..... H01H 83/04 361/42
6,828,886 B2 * 12/2004 Germain ..... H01H 83/04 335/18
6,937,451 B2 * 8/2005 Ulrich ..... H01H 83/04 361/42
7,196,885 B2 * 3/2007 Pierce ..... F21V 33/00 361/42
7,423,854 B2 * 9/2008 Gandolfi ..... H02H 3/14 361/42
7,855,514 B2 * 12/2010 Ku ..... H05B 33/0803 315/120
8,824,110 B2 * 9/2014 Zou ..... H01R 13/7135 361/42
2005/0264383 A1 * 12/2005 Zhang ..... H01H 83/04 335/18
2007/0159740 A1 * 7/2007 Williams ..... H01H 83/02 361/42
2008/0094764 A1 * 4/2008 Zhang ..... H01R 13/665 361/42
2008/0094765 A1 * 4/2008 Huang ..... H02H 3/335 361/42
2009/0251832 A1 * 10/2009 Brugner ..... H01R 13/6683 361/42

* cited by examiner

*Primary Examiner* — Alexander Talpalatski
(74) *Attorney, Agent, or Firm* — K.P. Correll & Associates, LLC

(57) ABSTRACT

A circuit interrupting safety device (CISD) interrupts the flow of current through a pair of lines extending between a source of power and a load. The CISD includes a column reset assembly functioning as a circuit breaker and latching device, a relay circuit including a solenoid, and a fault detecting circuit packaged in a circuit assembly.

17 Claims, 11 Drawing Sheets

CIRCUIT INTERRUPTING SAFETY DEVICE

1. FIELD OF USE

The present application is directed to resettable circuit interrupting safety devices (CISD) including without limitation ground fault circuit interrupters (GFCI's), arc fault circuit interrupters (AFCI's), immersion detection circuit interrupters (IDCI's), appliance leakage circuit interrupters (AFCI's), equipment leakage circuit interrupters (ELCI's), circuit breakers, contactors, latching relays and solenoid mechanisms. More particularly, the present application is directed to circuit interrupting devices that include a circuit interrupting portion that can break electrically conductive paths between a line side and a load side of the device and between a line side and a user load. Certain embodiments of the present application are directed to circuit interrupting devices including a reset lockout portion capable of preventing the device from resetting if the circuit interrupting portion is not functioning, if an open neutral condition exists or if the device is mis-wired. Certain embodiments of the present application are directed to methods of manufacturing circuit interrupting devices to be initially in a tripped condition.

2. DESCRIPTION OF PRIOR ART

Background

A CISD such as a Leakage Current Detector Interrupter (LCDI) may be a type of circuit interrupting device that detects a short circuit between conducting materials (e.g., wires, shield) of a power cord.

Many electrical wiring devices have a line side, which is connectable to an electrical power supply, and a load side, which is connectable to one or more loads and at least one conductive path between the line and load sides. Electrical connections to wires supplying electrical power or wires conducting electricity to the one or more loads are at line side and load side connections. The electrical wiring device industry has witnessed an increasing call for circuit breaking devices or systems which are designed to interrupt power to various loads, such as household appliances, consumer electrical products and branch circuits. In particular, electrical codes require electrical circuits in home bathrooms and kitchens to be equipped with ground fault circuit interrupters (GFCI), for example. Available GFCI devices, such as the device described in U.S. Pat. No. 4,595,894, use an electrically activated trip mechanism to mechanically break an electrical connection between the line side and the load side. Such devices are resettable after they are tripped by, for example, the detection of a ground fault. In the device discussed in the '894 patent, the trip mechanism used to cause the mechanical breaking of the circuit (i.e., the conductive path between the line and load sides) includes a solenoid (or trip coil). A test button is used to test the trip mechanism and circuitry used to sense faults, and a reset button is used to reset the electrical connection between line and load sides.

For example, a typical LCDI device comprises a housing having a three prong plug and a power cord. The power cord emanates from the housing and typically is directly connected to an electrical household device (e.g., air conditioner unit, refrigerator, and computer). The plug is used for a standard connection to an AC (Alternating Current) outlet that provides power. Thus, when the plug is connected to an electric power source (e.g., AC outlet) electrical power is provided to the device via the LCDI and the power cord connected thereto. The power cord typically comprises a hot or phase wire, a neutral wire and a ground wire each of which is insulated. All three wires are enclosed or are wrapped by a shield which is made of electrically conducting material that is typically not insulated. The shield and the wires are all enclosed in an insulating material (e.g., rubber or similar type material) thus forming the power cord. Circuitry residing within the housing detects electrical faults resulting from electrical shorts that occur between any of the wires and the shield. When an electrical fault is detected the circuitry trips the LCDI causing the LCDI to disconnect power from the power cord and the device eliminating a hazardous condition. In particular, a circuit interrupting device such as an LCDI device is designed to prevent fires by interrupting the power to the cord, if current is detected flowing from the phase, neutral or ground wires (in the cord) to the shield within the cord. This flow of current may be caused by degradation of the insulation around the wires due to arcing, fire, overheating, or physical or chemical abuse. The current flowing between any of the wires and the shield is referred to as leakage current.

The LCDI circuitry residing within the housing typically comprises, amongst other circuits, a fault detecting circuitry and a mechanism which trips the LCDI when an electrical fault is detected. The detection portion detects the existence of an electrical fault (e.g., arcing, electrical short across between damaged wires of the power cord) based on a first threshold voltage. An electrical fault is any set of circumstances that results in current flow between either the phase, neutral or ground wires of an electrical cord and the conductive shield of that cord. Once an electrical fault is detected, the tripping mechanism causes the LCDI to be disconnected from the power supply based on a second threshold voltage.

Yet, the prior art devices are generally bulk and often times difficult to manufacture due to the number and arrangement of parts. Therefore, there exists a need for an improved circuit interrupting safety device (CISD).

BRIEF SUMMARY

The foregoing and other problems are overcome, and other advantages are realized, in accordance with the presently preferred embodiments of these teachings The CISD constructed according to this invention further includes: a circuit breaker having a columnar reset switch located in the CSID, said switch having a first position in which the source of power in its associated line is not connected to the load and a second position in which the source of power in its associated line is connected to the load. The switch being in a normally open configuration and prior to use the CISD having to be manually reset to connect the power to the load.

The CISD circuit arrangement further includes movable contact arms that are mechanically biased to keep the contacts in a normally open position. The contact arms may take the form of a contact-carrying bar mounted in a cantilever fashion by flexible supporting legs that provide the bias to a normally open position. An elongated actuating member is arranged to reciprocate adjacent the contact-carrying bar when manually energized through an appropriate push button. When pushed, the actuating member pushes the moveable contact arm ends to engage stationary contact arms thereby connecting the source of power to the load.

The invention is also directed towards circuit interrupting safety device (CISD). The CISD includes a reset column assembly; a contact actuator; a solenoid having a solenoid pin. The reset column assembly is adapted to reset the solenoid when depressed and latch the contact actuator when released. The solenoid pin operates to de-latch the contact actuator when the solenoid is actuated. The reset column also includes a cap visible through a boot to enable status determination of the CISD.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

The following brief definition of terms shall apply throughout the application:

The term "outer" or "outside" refers to a direction away from a user, while the term "inner" or "inside" refers to a direction towards a user;

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example; and If the specification states a component or feature "may," "can," "could," "should," "preferably," "possibly," "typically," "optionally," "for example," or "might" (or other such language) be included or have a characteristic, that particular component or feature is not required to be included or to have the characteristic.

Figure 1:
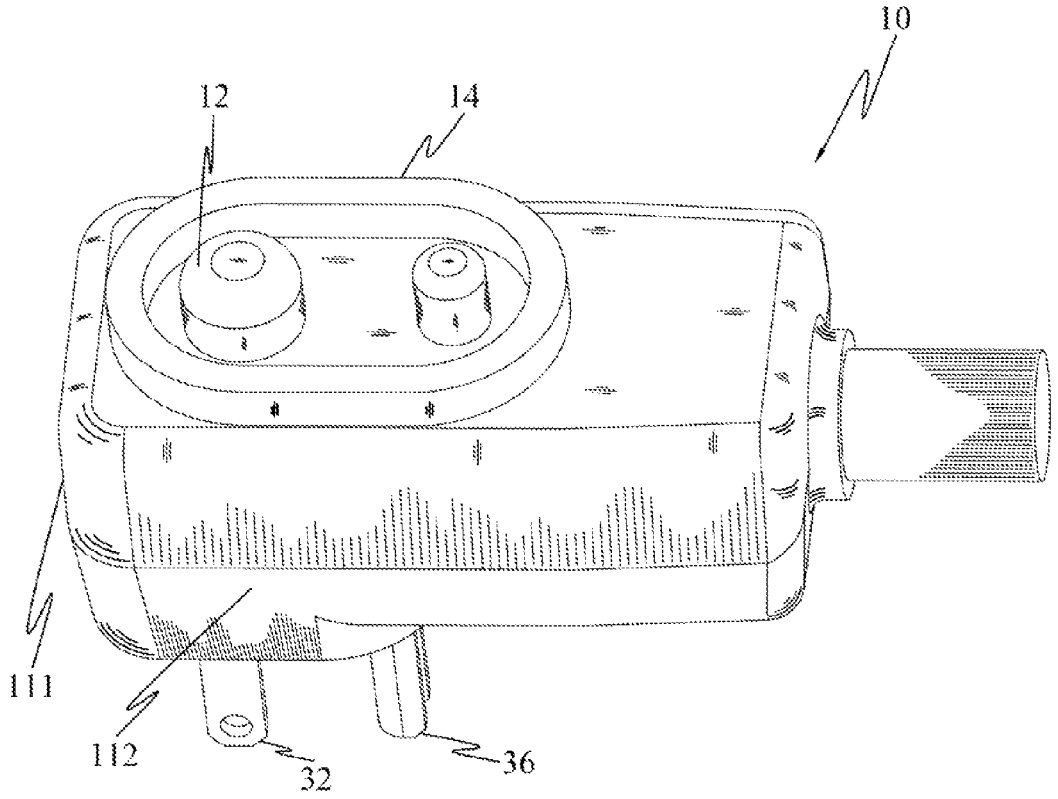
FIG. 1 is an isometric side view of the assembled CISD employing features of the subject invention shown in FIGS. 2-9.

Referring now to the drawings and more particularly to FIG. 1, there is shown a an isometric side view of the assembled CISD employing features of the subject invention constructed according to the teachings of the present invention, the CISD being represented generally by reference numeral 10.

As will be discussed in detail herein, CISD 10, is a manual reset type CISD circuit, and must be manually reset to connect power from the line to the load. Upon a sensed interrupt condition the power is interrupted between the line and load.

Still referring to FIG. 1 CISD 10 includes housing 111, boot housing 14, boot 12, contact blade 32, and ground pin 36. Boot housing 14 and housing 111 may be any suitable material such as high impact, Ultra Violet (UV) stabilized polyvinyl chloride (PVC). As will be described herein boot 12 may any suitable material such as rubber or plastic and suitably mated to boot housing 14 when boot 12, boot housing 14 and housing 111 are assembled to provide a watertight seal. Furthermore, as will be described herein, boot 12 may be clear or translucent to permit viewing of the internal test and reset buttons. Furthermore, CSID 10 may be assembled to meet UL 943 and NEMA 3R rating requirements. In addition, housing 111 may include an area 112 adapted to facilitate leverage and/or grasping by hand.

Figure 2:
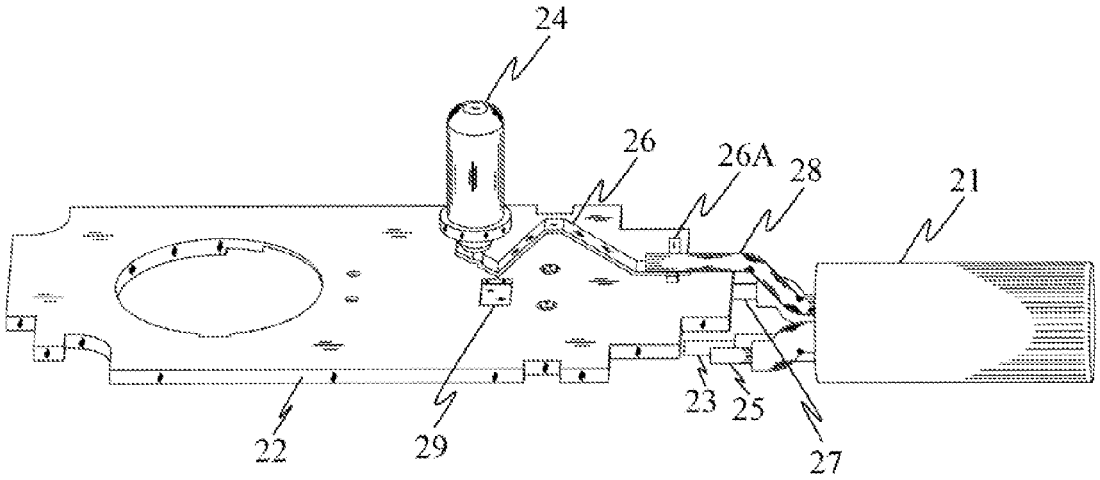
FIG. 2 is an isometric side view of the CISD employing the feature of combining the test contact arm with the solder braid terminal.

Referring also to FIG. 2 there is shown an isometric side view of the CISD employing the dual feature of incorporating the test contact arm 26 with the solder braid terminal 26A for attaching wire braid connector 28. It will be appreciated that incorporating the test contact arm (TCA) 26 function with the solder braid terminal 26A reduces the required number of components (e.g., a separate test contact arm and a separate solder braid terminal is not required).

Also shown in FIG. 2 is power cord 21. Power cord 21 includes braid connector 28, line wire 25, line wire 27, and ground wire 23. Reset button 24, when depressed operates to short test contact arm 26 to contact area 29 located on printed circuit board (PCB) 22. PCB 22 contains the logic and resources necessary to implement the circuits shown in FIGS. 10-13. It will be appreciated that test contact arm is shaped to provide inherent spring element to return the TCA its original position (e.g., not shorted to contact area 29) when reset button 24 is released, thus obviating the need for another part (e.g., a spring).

Figure 3:
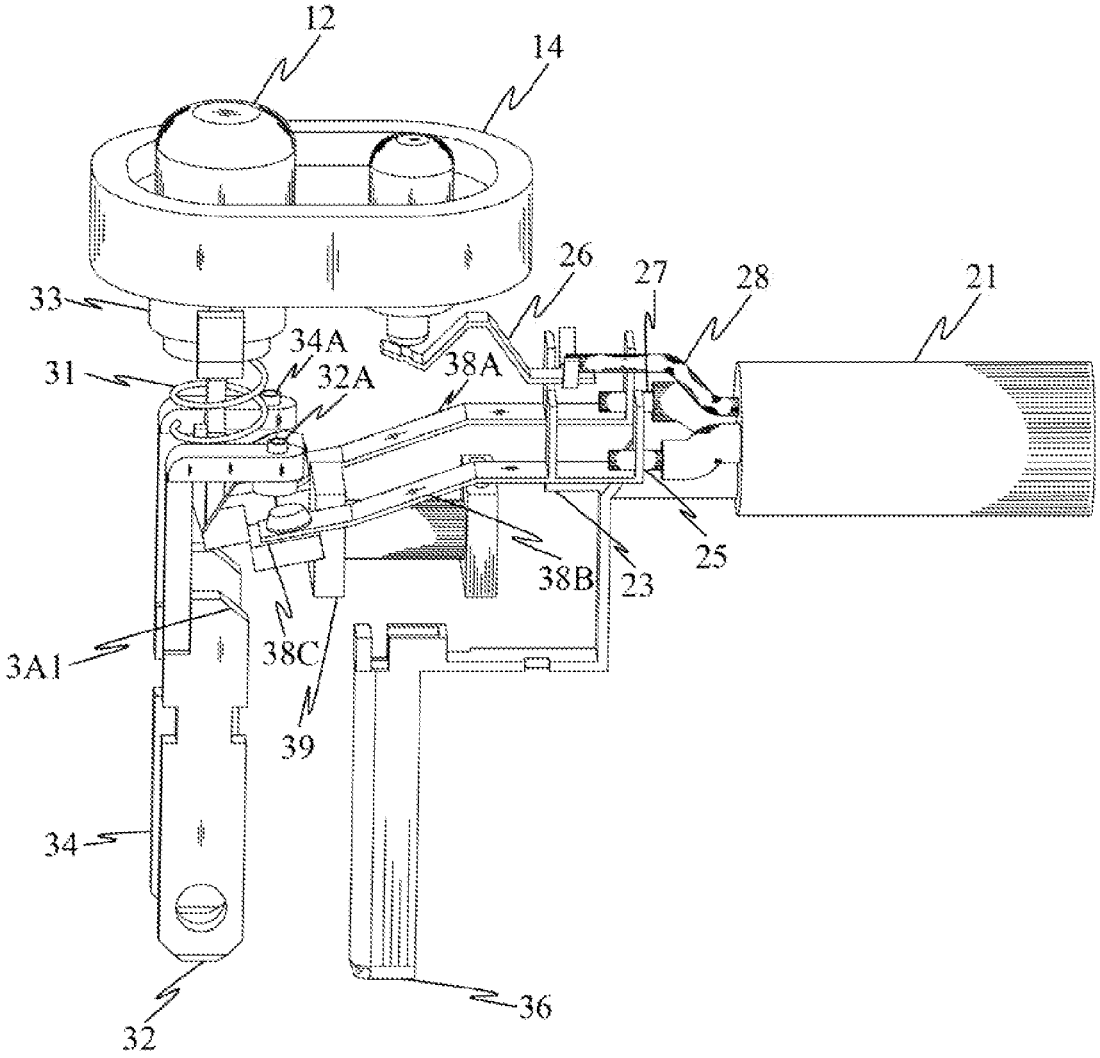
FIG. 3 is an internal isometric side partial view of the CISD employing features of the present invention.

Referring also to FIG. 3 there is shown a partial internal isometric side view of the CISD employing features of the present invention. Shown in FIG. 3 is left contact blade 32, right contact blade 34, ground pin 36, solenoid 39, reset spring 31, contact actuator 3A1, and reset column 33. Also shown in FIG. 3 is right moveable contact arm 38A, left moveable contact arm 38B, left contact rivet 38C, left blade contact rivet 32A, right blade contact rivet 34A. It will be appreciated that a right contact rivet is not shown in this view for clarity. However, the operation of providing power to the right contact blade 34 will be identical to the operation of delivering power to the left contact blade 32 as described herein.

Figure 3A:
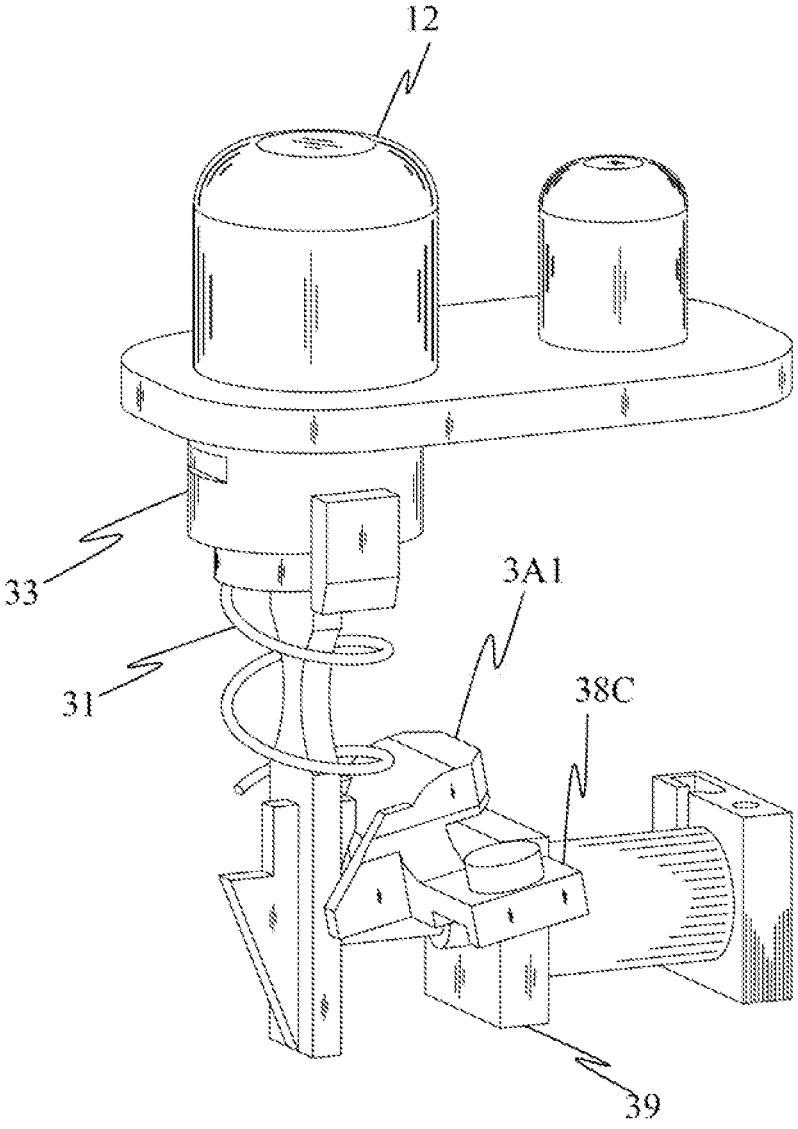
FIG. 3A is an internal isometric side partial view of the CISD reset column switch and solenoid employing features of the present invention.

Still referring to FIG. 3, as will be described in more detail herein, when reset column 33 is depressed downwards, compressing spring 31, solenoid 39 is reset to a spring loaded condition by contact actuator 3A1. When the reset column 33 is released, compressed spring 31 returns to its original position and causing reset column 33 to engage contact actuator 3A1, which in turn causes left contact rivet 38C to come into contact with left blade contact rivet 32A, thereby completing the circuit from power line 25 to left contact blade 32. Referring also to FIG. 3A there is shown an internal isometric side partial view of the CISD reset column switch 33 and solenoid employing features of the present invention Referring also to FIG. 4 there is shown an internal isometric side partial view of the CISD reset column switch and solenoid employing features of the present invention shown in FIG. 3A. As column reset switch is depressed downwards (in the direction of the arrow 41) engagement fin 33A operates to reset solenoid pin 39A (in the direction of arrow 42). It will be appreciated that reset solenoid pin 39A is beveled 43 to an angle consistent with an angle of the engagement fin 33A to permit a continuous and cooperative engagement between the reset solenoid pin 39A and the engagement fin 33A as the reset column 33 is depressed.

Figure 4:
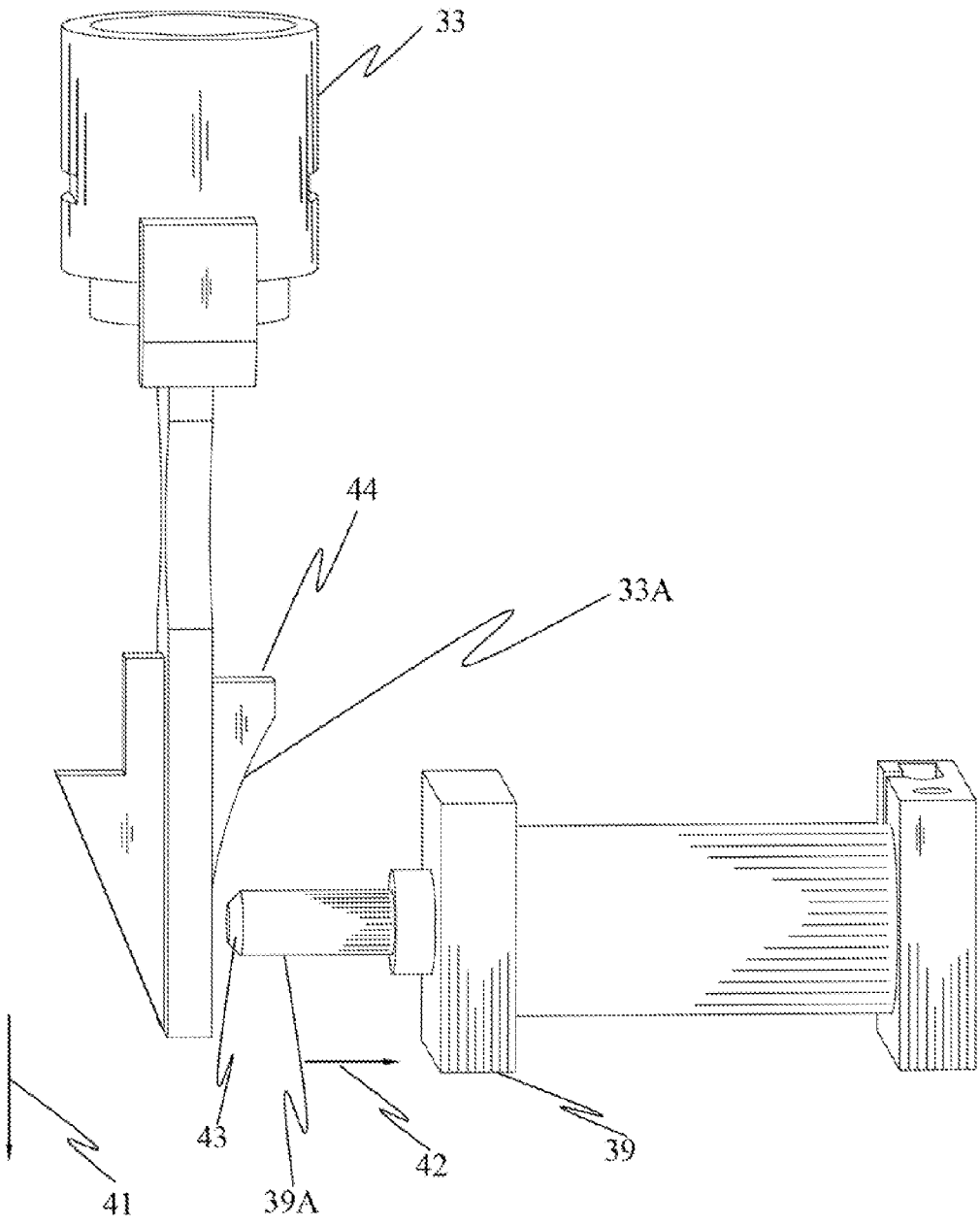
FIG. 4 is an internal isometric side partial view of the CISD reset column switch and solenoid employing features of the present invention shown in FIG. 3A.

Still referring to FIG. 4 and also to FIG. 2 again, PCB 22 contains the logic and resources necessary to determine if a circuit interruption should occur. As will be described herein, if PCB 22 logic and resources determine a circuit interruption should occur solenoid 39 is momentarily activated to extend reset solenoid pin 39A in a direction opposite to arrow 42. Thus, disengaging the reset column 33 from holding the contact actuator 3A1 in a closed position as discussed herein. Spring 31, having preloaded tension, operates to cause the contact actuator 3A1 to disengage the left contact rivet 38C from the left blade contact rivet 32A. Similarly for the right contact rivet and right blade contact rivet (not shown).

Figure 5:
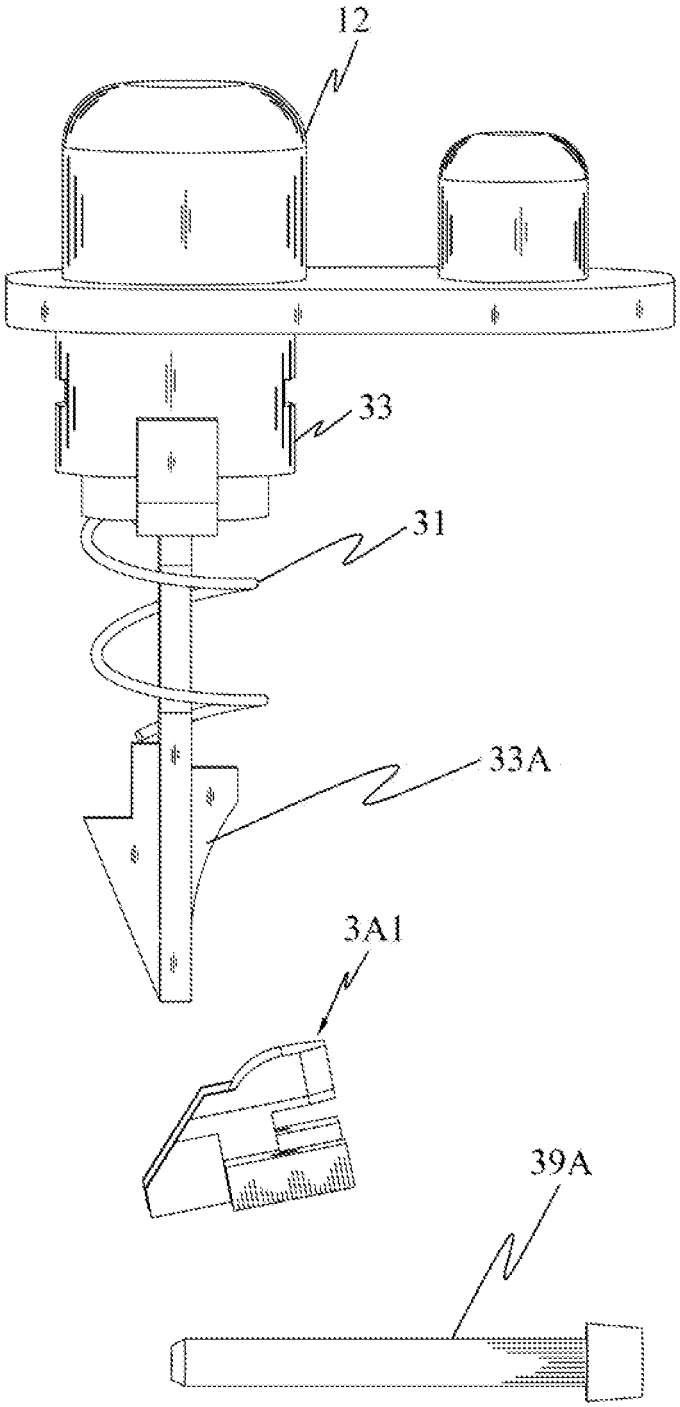
FIG. 5 is exploded side view of the CISD reset column switch and solenoid employing features of the present invention shown in FIG. 3A.
Figure 6:
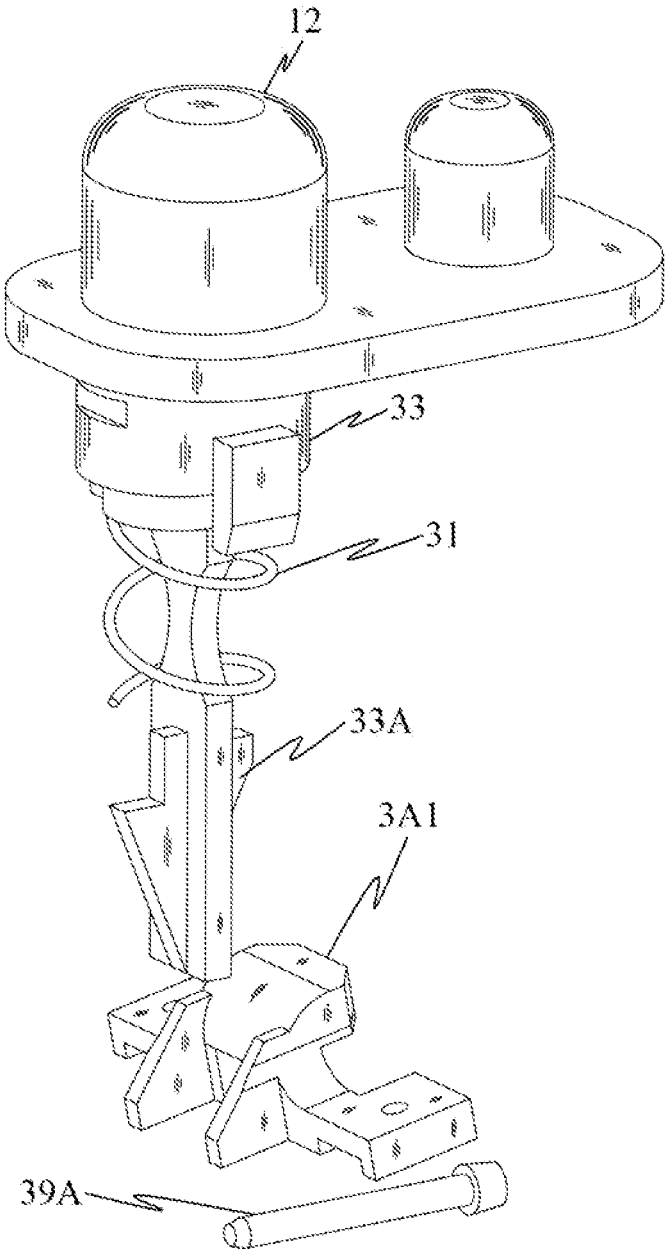
FIG. 6 is an internal isometric exploded partial view of the CISD reset column switch and solenoid employing features of the present invention shown in FIG. 3A.

Referring also to FIG. 5 there is shown an exploded side view of the CISD reset column switch and solenoid employing features of the present invention shown in FIG. 3A. Referring also to FIG. 6 there is shown an internal isometric exploded partial view of the CISD reset column switch and solenoid employing features of the present invention shown in FIG. 3A. FIG. 5 and FIG. 6 shown the relative exploded positions of the reset column 33, contact actuator 3A1, reset solenoid pin 39A and the engagement fin 33A.

Figure 7:
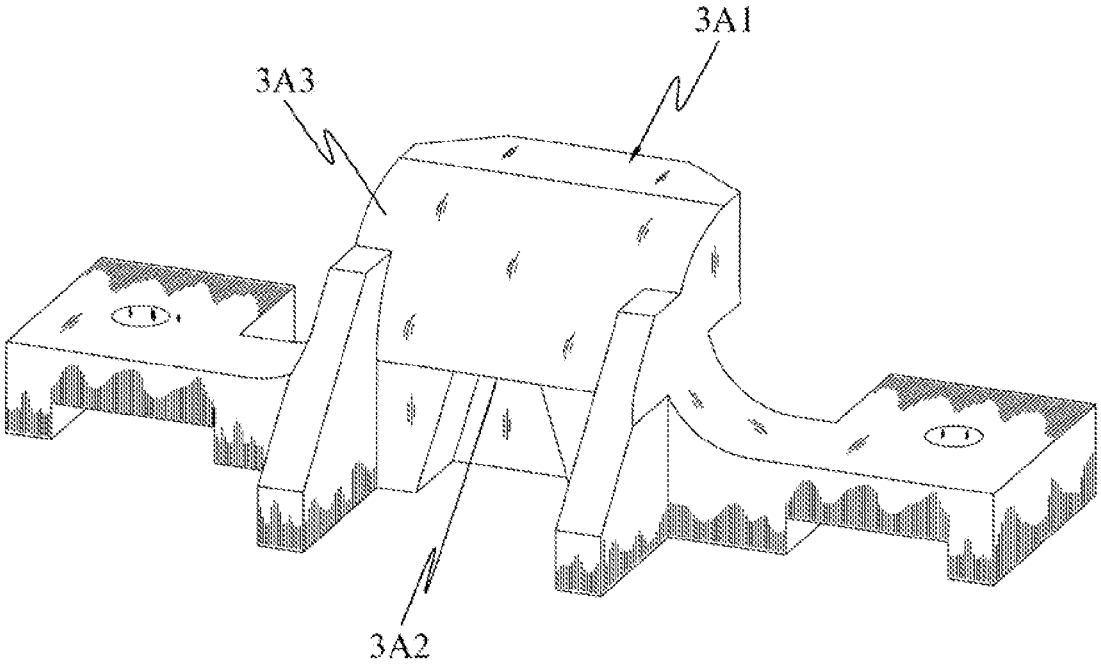
FIG. 7 is an isometric view of the contact actuator employing features of the present invention.

Referring also to FIG. 7 there is shown isometric view of the contact actuator 3A 1 discussed earlier. It will be appreciated that the engagement fin 33A discussed earlier, may engage the beveled area 3A3 of the contact actuator as the reset column 33 is depressed. As the reset column 33 is returning to its original position the engagement fin 33A lift ledge (see FIG. 4-44) operates to lift or rotate the contact actuator 3A1 via the contact actuator 3A1 lift and holding groove 3A2 to a closed position.

Figure 8:
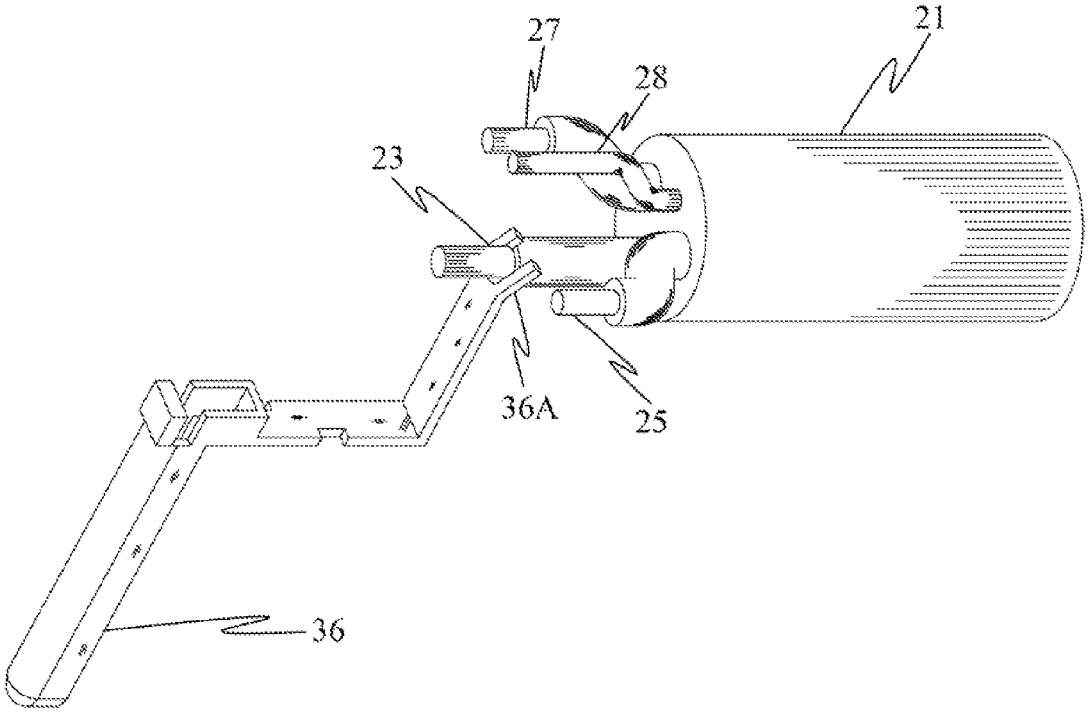
FIG. 8 is an internal isometric exploded partial view of the ground pin employing features of the present invention shown in FIG. 3.

Referring also to FIG. 8 there shown an internal isometric exploded partial view of the ground pin employing features of the present invention shown in FIG. 3. It will be appreciated that the ground pin 36 includes solder terminal 36A, thereby reducing the extra requirement for a separate solder terminal.

Figure 9:
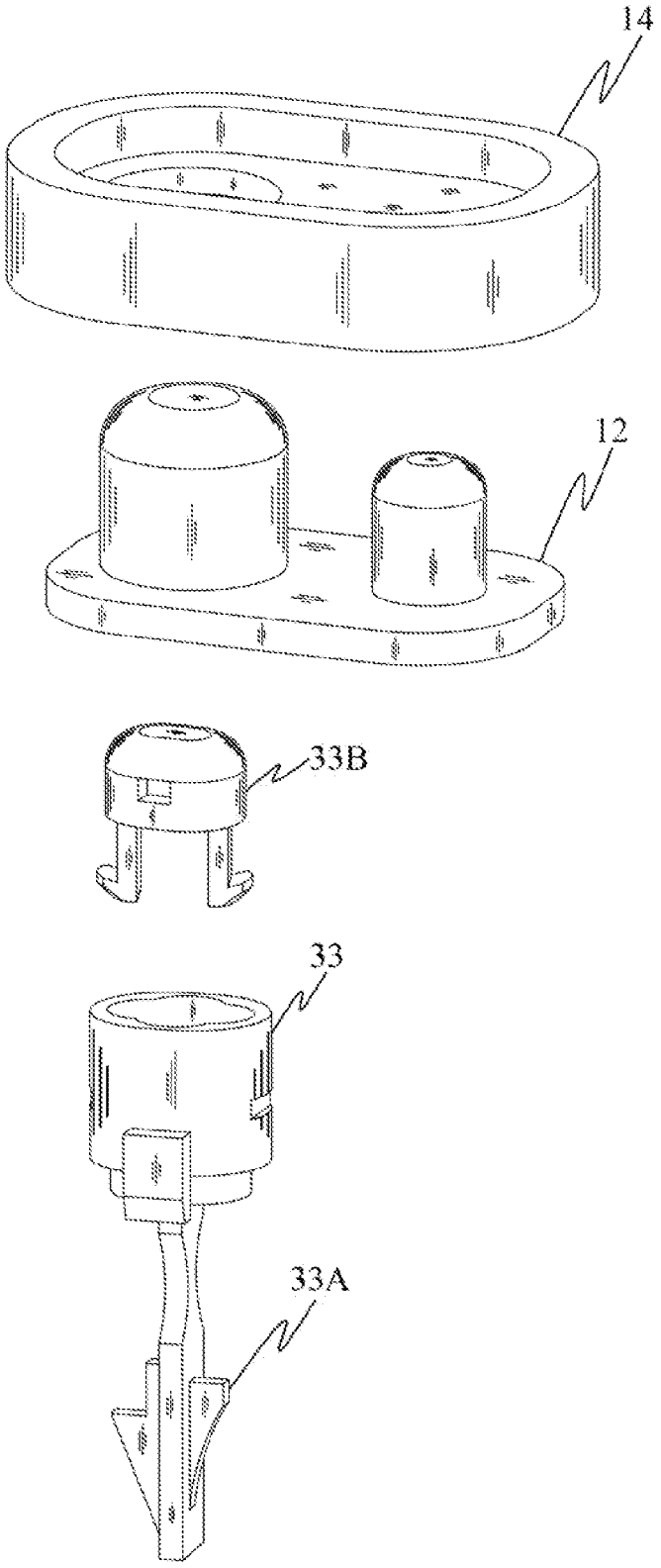
FIG. 9 is an exploded pictorial illustration of the columnar reset switch shown in FIG. 3.

Referring also to FIG. 9 is an exploded pictorial illustration of the columnar reset switch assembly shown in FIG. 3. The switch assembly includes reset column 33, reset cap 33*b*, boot 12, and housing 14. Boot 12 may be any suitable material such as a translucent or clear plastic, silicone, or rubber boot which permits visual identification of cap 33*b* or cap 33*b* appears as a different color when in the reset condition or when the CISD has been tripped or requires reset. It will be appreciated that this mechanical reset feature advantageously does not require an extra electrical circuit such as an electrical light emitting diode (LED) to indicate a reset condition.

Figure 10:
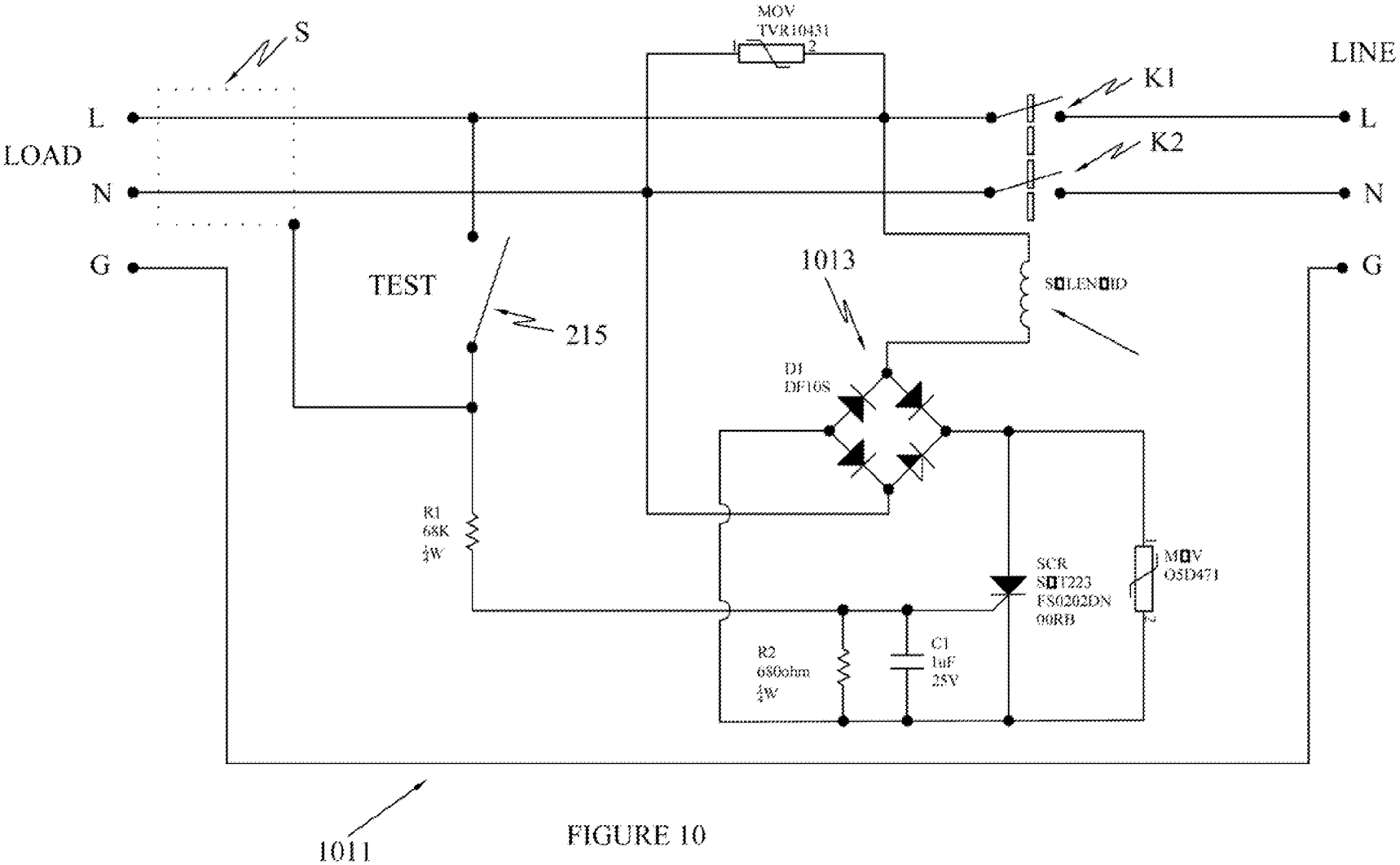
FIG. 10 is a schematic circuit diagram of an embodiment of a fireguard circuit constructed according to the teachings of the present invention.

Referring also to FIG. 10 there is shown a schematic circuit diagram of an embodiment of a fireguard circuit constructed according to the teachings of the present invention. Referring now to FIG. 10, there is shown a first embodiment of a fireguard circuit constructed according to the teachings of the present invention, the fireguard circuit being represented generally by reference numeral 1011. Fireguard circuit 1011 is designed principally for use as a safety device for a power cable 21 (See FIG. 2) which connects a power source (i.e., a line) to a load, said power cable 21 including a power line L and a neutral line N. Each of the power and neutral lines L and N is wrapped with a metal sheath or other similar type of shielded wrapping. The metal sheaths of the power and neutral lines L and N are, in turn, twisted together so as to effectively form a single metal sheath S which surrounds power line L and neutral line N.

As will be discussed in detail below, fireguard circuit 1011 interrupts the flow of current through power line L and neutral line N extending between the power source and the load when an arcing condition occurs either between power line L and metal sheath S or between neutral line N and metal sheath S. As can be appreciated, the presence of an arcing condition either between power line L and metal sheath S or between neutral line N and metal sheath S can result in a fire or other dangerous condition, which is highly undesirable.

Fireguard circuit 1011 (which is also referred to herein as safety circuit 1011) comprises a circuit breaker 13 which selectively opens and closes power line L and neutral line N. Circuit breaker 13 includes a first normally-closed switch K1 which is located in power line L between the power source and the load. Circuit breaker 13 also includes a second normally-closed switch K2 which is located in neutral line N between the power source and the load. See earlier discussion regarding contact actuator 3A1. Switches K1 and K2 can be positioned in either of two connective positions. Specifically, switches K1 and K2 can be positioned in either a first, or closed, position or a second, or open, position. With switches K1 and K2 disposed in their closed position, which is the opposite position as illustrated in FIG. 1, current is able to flow from the power source to the load. With switches K1 and K2 disposed in their open position, which is illustrated in FIG. 10, current is unable to flow from the power source to the load.

A solenoid SOL is ganged to the circuit breaker contacts of switches K1 and K2 and is responsible for selectively controlling the connective position of switches K1 and K2. Specifically, when solenoid SOL is de-energized, switches K1 and K2 remain in their closed positions. However, when solenoid SOL is energized, solenoid SOL moves contact actuator 3A (See FIG. 3) and switches K1 and K2 into their open positions.

A first silicon controlled rectifier SCR acts to detect the presence of an arcing condition between the power line L and the metal sheath S and to switch solenoid SOL from its de-energized state to its energized state upon detecting the presence of the arcing condition between the power line L and the metal sheath S. First silicon controlled rectifier SCR and includes an anode 21, a cathode 23 and a gate 25.

A voltage dropping resistor R1 has a value of approximately 68.0 Kohm. Resistor R1 is connected to metal sheath S and the SCR gate. Accordingly, the presence of an arcing condition between either power line L and metal sheath S or neutral line N and metal sheath S creates a current leakage which travels through resistor R1. As such, resistor R1 serves to drop the current leakage voltage to an acceptable level before said current leakage voltage is passed onto rectifiers SCR.

A first capacitor C1 serves to filter out high frequency noise from passing onto the gate connection of first rectifier SCR. First capacitor C1 preferably has a value of approximately 1.0 uF.

Metal-oxide varistors MOV protects against voltage surges in power and neutral conducting lines L and H and SCR.

In use, fireguard switch 1011 functions in the following manner. In the absence of arcing conditions, switches K1 and K2 are disposed in their normally-closed positions, thereby enabling AC power to pass from the power source to the load through power and neutral lines L and N.

Upon the presence of an arcing condition between power line L and metal sheath S, leakage voltage travels from metal sheath S and passes through resistor R1 (approximately 68 Kohms), resistor R1 dropping the leakage voltage to an acceptable level. The reduced leakage voltage triggers gate of rectifier SCR because the signal at gate is opposite in potential with respect to the polarity of SCR cathode. The triggering of gate causes first rectifier SCR to conduct which, in turn, energizes solenoid SOL. Once energized, solenoid SOL opens switches K1 and K2 to an off position which, in turn, serves to remove power from circuit 1011, thus eliminating the arcing condition.

Resistor R2 (approximately 680 ohms) is connected in parallel with capacitor C1 with one of its terminals connected to gate of first rectifier SCR and the other of its terminals connected to cathode of first rectifier SCR.

Test switch 215 is included in fireguard circuit 1011, test switch 215 connecting power line L (at a location between sheath S and resistor R1).

Fireguard circuit 1011 includes a diode bridge 1013. In use, diode bridge 1013 in fireguard circuit 1011 acts to detect the presence of an arcing condition between neutral line N and metal sheath S1 and to switch solenoid SOL from its de-energized state to its energized state upon detecting the presence of the arcing condition between neutral line N and metal sheath S1.

The section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Finally, it will be understood that use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

The invention claimed is:

1. A circuit interrupting safety device (CISD), the CISD comprising:
- a reset column assembly, wherein the reset column assembly comprises:
- a reset column, wherein the reset column comprises:
  - an engagement fin, wherein the engagement fin comprises
    - a surface adapted to maintain continuous contact with the solenoid pin when the reset column is depressed;
      - wherein the engagement fit is adapted to reset the solenoid when depressed and engage the contact actuator when released;
      - and a reset cap adapted to fit within the reset column;
- a contact actuator; and
- a solenoid wherein the solenoid comprises:
  - a solenoid pin.

2. The CISD as in claim 1 further comprising:
- a ground pin (GP) connector, wherein the ground pin connector comprises a GP solder terminal.

3. The CISD as in claim 1 further comprising:
- a test contact arm, wherein the test contact arm (TCA) comprises:
  - a spring element; and
  - a TCA solder terminal.

4. The CISD as in claim 1 further comprising:
- a boot, wherein the boot is semi-transparent to allow visible identification of the reset cap thereby identifying reset or set status of the CISD.

5. The CISD as in claim 1 wherein the engagement fin comprises a lift ledge for engaging the contact actuator.

6. An interrupting safety device (ISD), wherein the ISD comprises:
- a non-conducting contact actuator having two opposite ends;
- a left contact blade;
- a right contact blade;
- a left moveable contact arm affixed to one end of the non-conducting contact actuator, wherein the left moveable contact arm is adaptable to engage the left contact blade;
- a right moveable contact arm affixed to an opposite end of the non-conducting contact actuator, wherein the right moveable contact arm is adaptable to engage the right contact blade;
- a column reset assembly for engaging or disengaging the non-conducting contact actuator such that the left moveable contact arm is engaged to or disengaged from the left contact blade and the right moveable contact arm is engaged to or disengaged from the right contact blade, wherein the column reset assembly comprises:
  - an engagement fin adapted to engage and reset a solenoid pin when the column reset is depressed; and an engagement fin, wherein the engagement fin comprises a surface adapted to maintain continuous contact with the solenoid pin when the column reset is depressed.

7. The ISD device as in claim 1, wherein the reset column comprises a reset cap adapted to fit within the reset column.

8. The ISD as in claim 7 further comprising:

a boot, wherein the boot is semi-transparent to allow visible identification of the reset cap thereby identifying reset or set status of the ISD.

9. The ISD as in claim 6 further comprising:

a ground pin (GP) connector, wherein the ground pin connector comprises a GP solder terminal adaptable to affixing a ground wire.

10. The ISD as in claim 6 further comprising:

a test contact arm, wherein the test contact arm (TCA) comprises:

a spring element; and a TCA solder terminal adaptable to affixing a shield connector.

11. The ISD as in claim 6 further comprising logic and resources for actuating the solenoid pin if determining a circuit interruption should occur, wherein the logic and resources comprise a silicon controlled rectifier (SCR) detection circuit.

12. The ISD as in claim 6 further comprising logic and resources for actuating the solenoid pin if determining a circuit interruption should occur, wherein the logic and resources comprise diode bridge rectifier (DBR) detection circuit.

13. The ISD as in claim 6 further comprising a housing wherein the housing comprises a plurality of hand holds adapted for facilitating hand grasping.

14. A safety device comprising:

a non-conducting contact actuator having two opposite ends;

a left contact blade;

a right contact blade;

a left moveable contact arm affixed to one end of the non-conducting contact actuator, wherein the left moveable contact arm is adaptable to engage the left contact blade;

a right moveable contact arm affixed to an opposite end of the non-conducting contact actuator, wherein the right moveable contact arm is adaptable to engage the right contact blade;

a column reset assembly for engaging or disengaging the non-conducting contact actuator such that the left moveable contact arm is engaged to, or disengaged from, the left contact blade and the right moveable contact arm is engaged to, or disengaged from, the right contact blade, wherein the column reset assembly comprises:

an engagement fin adapted to engage and reset a solenoid pin when the column reset is depressed; and wherein the engagement fin comprises a surface adapted to maintain continuous contact with the solenoid pin as the column reset is depressed;

a first silicon controlled rectifier (SCR) for detecting the presence of an arcing condition, said first SCR setting said column reset assembly such that the left moveable contact arm is disengaged from the left contact blade and the right moveable contact arm is disengaged from the right contact blade upon detecting the presence of an arcing condition; and a diode bridge connecting the first SCR to the circuit opening device, the diode bridge acting to detect the presence of a second arcing condition, said diode bridge setting said column reset assembly such that the left moveable contact arm is disengaged from the left contact blade and the right moveable contact arm is disengaged from the right contact blade upon detecting the presence of an arcing condition.

15. The safety device as in claim 14 wherein the solenoid pin is ejected when the SCR or diode bridge detects the presence of a first or second arcing condition, respectively.

16. The safety device as in claim 15, wherein the reset column comprises a reset cap adapted to fit within the reset column.

17. The safety device as in claim 16 wherein the reset column comprises:

a boot, wherein the boot is semi-transparent to allow visible identification of the reset cap thereby identifying reset or set status of the ISD.

* * * * *